US005475578A

United States Patent [19]

Sevack et al.

[11] Patent Number: 5,475,578

[45] Date of Patent: Dec. 12, 1995

[54] ALIGNING BEADED FASTENER ASSEMBLY FOR LIGHTING FIXTURES

[76] Inventors: David Sevack, 25 Northcote Road, Montreal, Quebec, Canada, H3X 1P9; Jules Pallai, 1515 Evergreen, St. Bruno, Quebec, Canada, L3V 4C6

[21] Appl. No.: 226,456

[22] Filed: Apr. 12, 1994

[51] Int. Cl.[6] ..... F21S 1/06

[52] U.S. Cl. ..... 362/405; 248/344

[58] Field of Search ..... 362/405, 406, 362/249, 252, 431, 147; 248/344

[56] References Cited

U.S. PATENT DOCUMENTS

| | | | |
|---|---|---|---|
| 1,530,993 | 3/1925 | Framburg | 362/406 |
| 4,477,866 | 10/1984 | Goralnik | 362/405 X |
| 4,748,549 | 5/1988 | Scheer | 362/406 |

*Primary Examiner*—Stephen F. Husar
*Attorney, Agent, or Firm*—Alfred M. Walker

[57] ABSTRACT

A locking assembly for lighting fixtures or portable lamps is provided to facilitate the fast assembly and alignment of longitudinally extending arms, such as hollow tubular arms, either on the flat surface, or on the vertical exterior surface of a base of the lighting fixture or portable lamp, without the use of additional machined or cast fittings. A bead is formed near the end of the arm, wherein the bead includes one or more indentations made of rectangular, square, round or other shapes, so that a projection or projections protrude from the opposite flat surface of the bead. The end of the tube beyond the bead is then threaded and if bent into an arm, the bending is done in the same plane as a line running through the center of the tube and one projection. One or more rounded holes slightly larger than the diameter of the tube are provided in the flat surface of the plates or bodies or onto the vertical sides of the bodies of the lighting fixture or portable lamp. These holes have on their circumferences one or more slotted or notched openings of such size so as to receive the end of the longitudinally extending arms and the projections of the bead, so that location of these holes is quickly located and the arms are aligned with the hole or holes in relation to the plate or body.

14 Claims, 7 Drawing Sheets

ALIGNING BEADED FASTENER ASSEMBLY FOR LIGHTING FIXTURES

FIELD OF THE INVENTION

The present invention is directed to a novel beaded fastener to facilitate the fast assembly and alignment of tubular or otherwise hollow arm lighting fixture or portable lamp components. The components, which may be straight or bent, are aligned and assembled onto round or shaped plates of suitable materials, such as metal or plastic, or drawn, formed or otherwise three dimensional shaped bodies, wherein the tubular arms are aligned either on the flat surface, or on the vertical exterior surface of the three dimensional body without the use of additional machined or cast fittings.

BACKGROUND OF THE INVENTION

To fasten structural components of a lighting fixture or portable lamp, such as connecting tubes of a chandelier, the prior art includes longitudinally extending arm components, such as, for example, hollow tubular members, which are threaded and/or soldered to engage with a machined or cast piece and nut, to attach the tubular component to a base plate through a bore therein.

Normally the bores of a base plate are slightly larger than the diameter of the lighting fixture or portable lamp tube being aligned into the flat surface of the plates or bodies or onto the vertical sides of the bodies.

In the prior art, these holes have linear straight facets on their circumferences so as to receive the end of the tube therein. However, it is difficult and time consuming to locate and align the tubular arm in relation to the plate or body. After passing the end of the tube or arm through the plate or body, a conventional nut is then threaded onto the end of the tube or arm and tightened. Often, a lockwasher is required and once tightened, the tube or arm tends to loosen from its original position, unless tightened also by an auxiliary lock washer.

Therefore, in the prior art, it is a time consuming task to locate and install tubes and arms onto plates and bodies, which necessitates the use of complicated assembly jigs and additional machined or cast fittings and soldering, which adds delay and increases the cost of labor and of assembly jigs.

OBJECTS OF THE INVENTION

It is an object of the present invention to facilitate the fast assembly and alignment of longitudinally extending lighting fixture or portable lamp arms, such as hollow tubular arms or the like, which are straight or bent, onto round or shaped plates of metal or plastic, or drawn, formed or otherwise shaped bodies, either on the flat surface, or on the vertical exterior surface of the body.

It is yet another object to install the tubular arms without the use of additional machined or cast fittings.

It is yet a further object to provide a fastener with a circumferential bead which is formed near the end of the tube.

It is a further object to provide a base plate for lighting fixtures with indentations which are engagable with projections which protrude from a circumferential bead around the fastener.

It is yet another object to provide a base plate for a lighting fixture with one or more rounded holes which are slightly larger than the diameter of the tube being attached and placed through the flat surface of the base plates. Wherein the holes have on their circumferences one or more slot or notched openings of such size so as to receive the projections of the circumferential bead.

It is yet a further object to provide a means for quickly locating and aligning the tube in relation to the base plate of a lighting fixture or portable lamp.

It is yet another object to provide a fastener for tubular members of a lighting fixture or portable lamp wherein lockwashers are not required.

It is yet a further object to provide a fastener for a lighting fixture or portable lamp tubular member wherein the tube or arm remains in its original position when tightened.

It is yet another object to provide a component for a lighting fixture or portable lamp which allows the various tubular arms to be swivelled out of position, from a base plate or body into a more compact form, thereby reducing the size of the package required.

It is yet a further object to provide a lighting fixture wherein the component tubes and arms can be easily and quickly assembled onto plates and bodies without the use of assembly jigs and additional machined or cast fittings.

It is a further object to improve over the disadvantages of the prior art.

SUMMARY OF THE INVENTION

In keeping with these objects and others which will become apparent, the present invention includes a lighting fixture or portable lamp fastener assembly with a base plate or body and a plurality of tubular arms which are attached through and to the base plate or body.

In order to accomplish the rapid and secure assembly of the tubular arms to the base plate or body, a fastener including a bead is provided near the end of the tube.

The bead is a circumferential protrusion surrounding each tube being assembled to the base plate or body. Into one flat surface of the bead, one or more indentations are made of rectangular, square, round or other shapes, so that a projection or projections protrude from the opposite flat surface of the bead. The end portion of the tube is situated beyond the circumferential bead and is then threaded and if bent into an arm, the bending is done in the same plane as a line running coaxially through the center axis of the tube and at the axis of the least one projection.

To accommodate the projections extending forward of the bead, one or more rounded holes slightly larger than the diameter of the tube are punched into the flat surface of the plates or bodies or onto the vertical sides of the bodies. These round holes will have on their circumferences one or more slot or notched opening of such size so as to receive the end of the tube and the projections. The location of these holes serves to quickly locate and align the tube or arm in relation to the plate or body.

Upon passing the end of the tube or arm through the plate or body until the projections are located in the slots or notches, a nut is then threaded onto the end of the tube or arm and tightened. Therefore, a lockwasher is not required and once tightened, the tube or arm remains in its original position.

Furthermore, if a suitable spring lockwasher is used under the nut and the nut is tightened with sufficient torque so as to compress the spring lockwasher just enough to allow the arm to be swivelled out of position, this would allow the arms of a multi-armed plate or body to be moved into a more compact form, thereby reducing the size of the package required, resulting in lower packaging, shipping and storage costs. The purchaser of the fixture would just have to pull the arms together until the projections snap into place. The nut would have to be locked in place with "LOCTITE" or a similar adhesive.

The configuration of the lighting fixture or portable lamp assembly of the present invention makes it easy to quickly locate and assemble tubes and arms onto plates and bodies without the use of assembly jigs and additional machined or cast fittings, thereby saving time and the cost of labor and jigs, and to reduce the costs of packaging, shipping and storage by allowing the arms to be swivelled to a more compact form, permitting smaller packaging.

DESCRIPTION OF THE DRAWINGS

The invention can best be understood in conjunction with the following drawings in which.

DETAILED DESCRIPTION OF THE DRAWINGS

Figure 4:
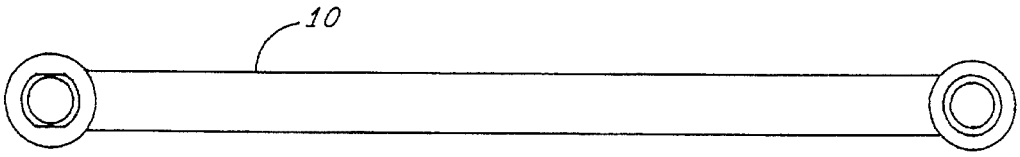
FIG. 4 (PRIOR ART)
FIG. 4 is a top plan view of the tubular component of the prior art lighting fixture structure as in FIG. 1.
Figure 1:
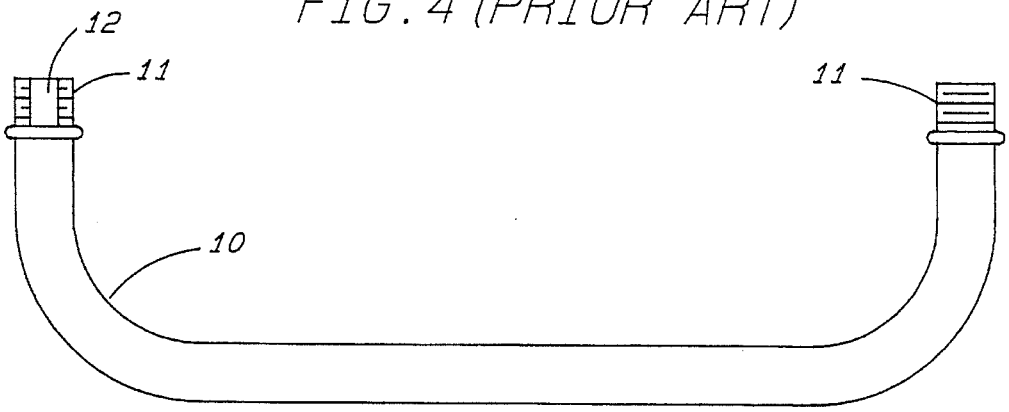
FIG. 1 (PRIOR ART)
FIG. 1 is a side elevational view of a prior art fastener of a tubular arm component of a prior art lighting fixture structure.
Figure 3:
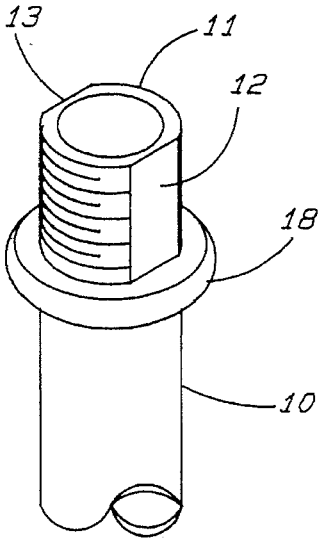
FIG. 3 (PRIOR ART)
FIG. 3 is a closeup perspective view of a portion of a prior art tubular component, as shown in the dotted lines of FIG. 1.
Figure 2:
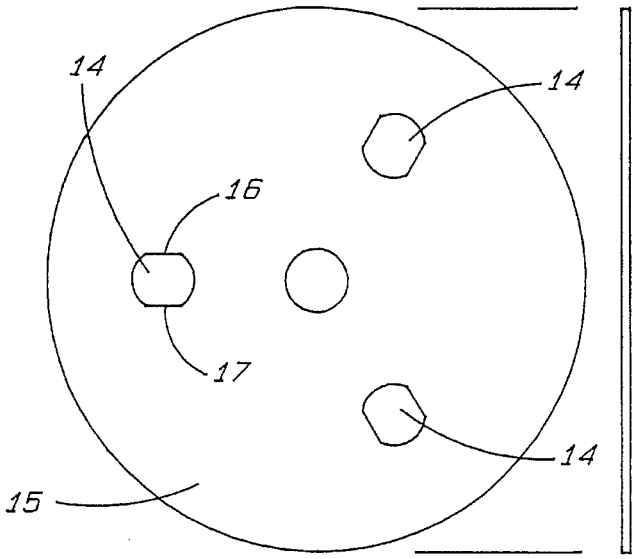
FIG. 2 (PRIOR ART)
FIG. 2 is a top plan view of a base plate portion component of a prior art lighting fixture.
Figure 8:
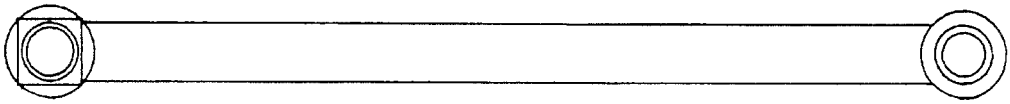
FIG. 8 (PRIOR ART)
FIG. 8 is a top plan view of the tubular component of another prior art lighting fixture structure as in FIG. 5.
Figure 5:
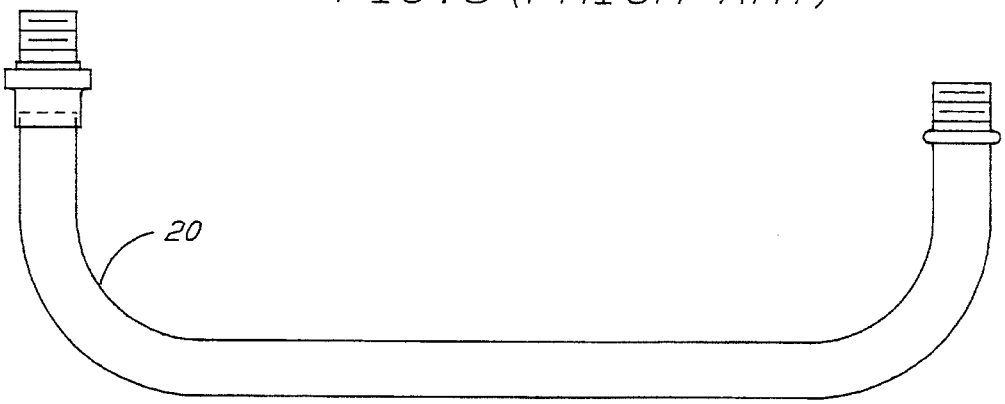
FIG. 5 (PRIOR ART)
FIG. 5 is a side elevational view of another prior art fastener of a tubular arm component of a prior art lighting fixture structure.
Figure 7:
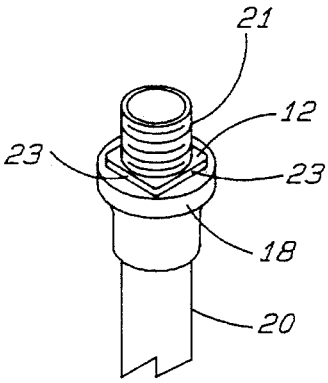
FIG. 7 (PRIOR ART)
FIG. 7 is a closeup perspective view of a portion of another prior art tubular component, as shown in the dotted lines of FIG. 5.
Figure 6:
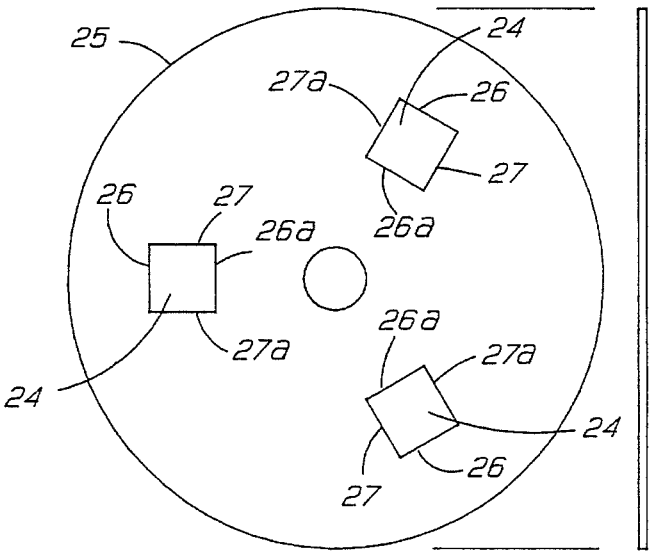
FIG. 6 (PRIOR ART)
FIG. 6 is a top plan view of a base plate portion component of another prior art lighting fixture.
Figure 9:
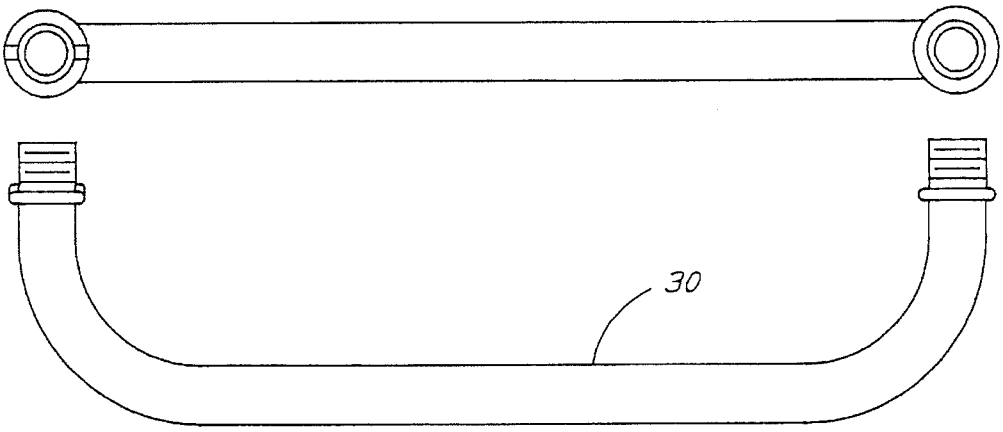
FIG. 9 is a side elevational view of a tubular arm component of the assembly of the present invention.
Figure 11:
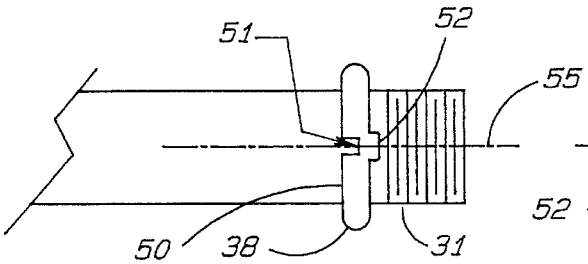
FIG. 11 is a closeup side elevational view of the beaded fastener portion of the tubular arm component as in FIG. 9.
Figure 12:
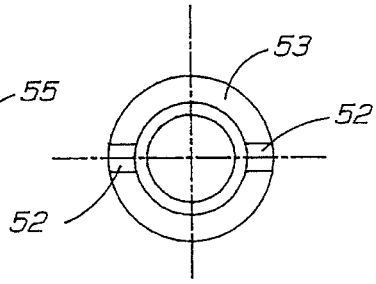
FIG. 12 is a top plan view of the beaded fastener portion of the tubular arm component as in FIG. 11.
Figure 14:
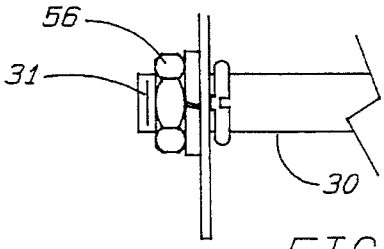
FIG. 14 is a closeup view of the tubular arm portion joined to the base plate portion of the assembly of the present invention, shown in a closed position.
Figure 10:
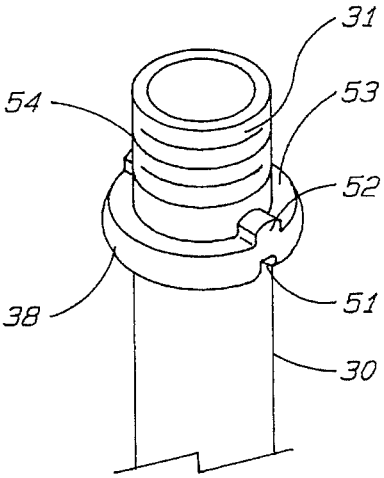
FIG. 10 is a closeup perspective view of the beaded fastener portion of the tubular arm component as in FIG. 9.
Figure 13:
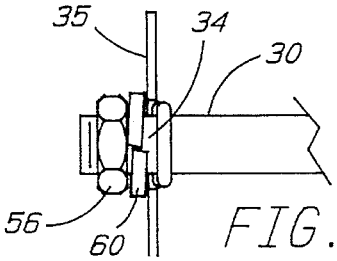
FIG. 13 is a closeup view of the tubular arm portion joined to the base plate portion of the assembly of the present invention, shown in an open position.
Figure 15:
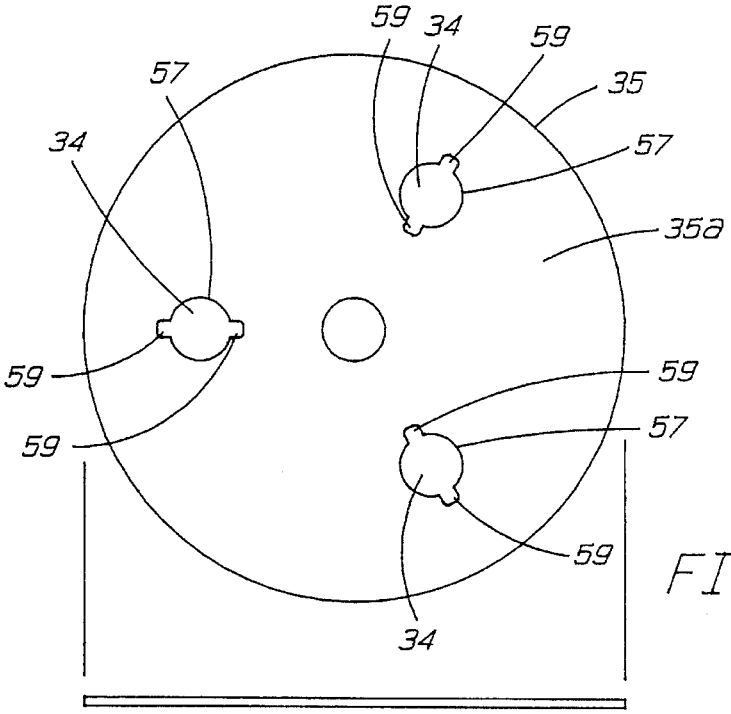
FIG. 15 is a top plan view of a base plate of a first embodiment of the present invention.

As shown in FIGS. 1–4, a prior art lighting fixture or portable lamp structure includes a tubular arm 10 with threaded end portions 11 having machined flat facets 12,13 therein, so that the threaded portion 11 may be inserted within corresponding bore 14 of a base plate 15. Bore 14 includes truncated flat edges 16, 17 to aligning facets 12, 13 therein, so that threaded portion 11 may be inserted within bore 14 up to cylindrical beaded stop 18 surrounding tubular member 10. This requires costly and time consuming machining of the flat facets 12, 13.

As shown in FIGS. 5–8, a further prior art lighting fixture or portable lamp assembly includes a tubular arm 20 with threaded end portions 21 having a square base 12 with flat perpendicular surfaces 23 in a common plane therein, so that the four perpendicular flat surfaces 23 may be inserted within corresponding bores 24 of base plate 25. Bores 24 are square shaped with edges 26, 26*a*, 27, 27*a* for aligning the four flat edges 23 therein, to insert threaded portion 21 within bore 24 up to cylindrical machined beaded stop 18 surrounding tubular member 20. Both of the prior art assemblies have the disadvantages of costly and time consuming machining to each of the flat surfaces.

Figure 16:
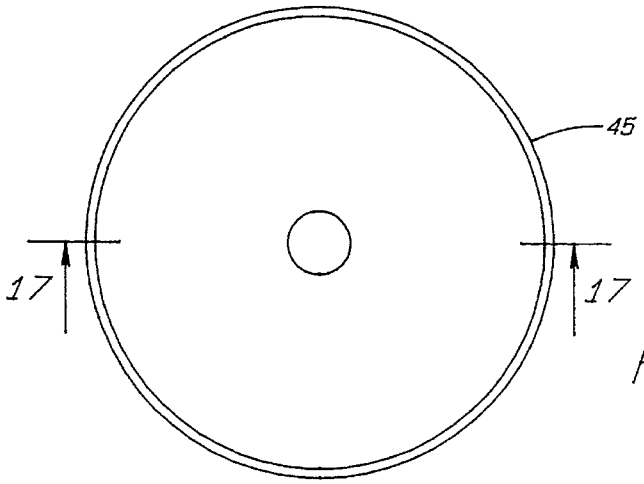
FIG. 16 is a top plan view of a cylindrical base body of a further embodiment of the present invention.
Figure 17:
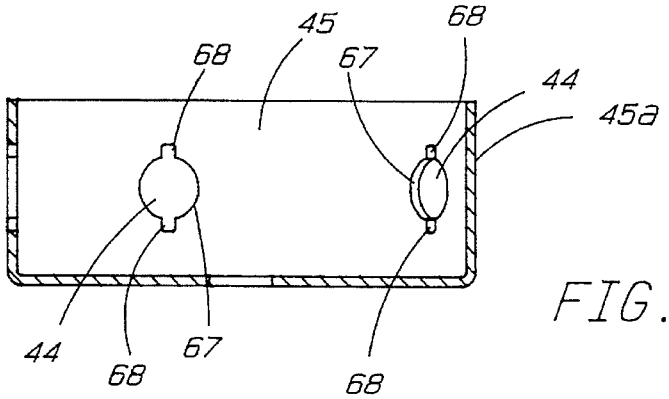
FIG. 17 is a side elevational view of the cylindrical base body of the further embodiment as shown in FIG. 16, shown in partial section along lines 17—17 of FIG. 16.

Therefore, as shown in FIGS. 9–15, the present invention facilitates the fast assembly and alignment of lighting fixture tubular arms 30, which may be straight or bent, onto a flat surface 35*a* of base plate 35, such as a flat metal plate, or as shown in FIGS. 16 and 17, a drawn, formed or otherwise three dimensional shaped base body 45, such as an open cylinder. Tubular arms 30 penetrate either through bores 34 of flat surface 35*a*, of base plate 35 or through bores 44 of vertical exterior surface 45*a* of cylindrical base body 45.

In order to dispense with the need for expensive machined or cast fittings, there is provided in the present invention, as shown in FIGS. 9–14, a circumferentially extending bead 38 formed near threaded end 31 of tubular arm 30. Into one flat surface 50 on bead 38, one or more indentations 51 are made of rectangular, square, round or other geometric shapes, so that one or more projections 52 protrude from the opposite flat surface 53 of bead 38. The end 31 of tubular arm 30 beyond the bead 38 is then threaded with threads 54. If tubular arm 30 is bent into an arm, the bending is done in the same plane as a line running through the center 55 of tubular arm 30 and one projection 52.

One or more rounded bore holes 34 slightly larger than the diameter 54 of tubular arm 30 are punched into the flat surface 35*a* of the base plate 35. Round holes 34 include on their circumferences 57 one or more slot or notches openings 59 corresponding to such size so as to receive threaded 31 end of tubular arm 30 and projections 52 therethrough.

The location of bore holes 34 functions to quickly locate and align the tubular arm 30 in the proper alignment with bore holes 34 to plate 35. Upon passing the end of the tubular arm 30 through base plate 35 until the projections 52 are located in the slots 59 of bore holes 34. For tightening, a nut 56 is then threaded onto the end 31 of tubular arm 30 and tightened. This obviates the need for a lockwasher. Once tightened, tubular arm 30 remains in its seated position within base plate 35 or base body 45.

With respect to a three dimensional base body, such as cylinder 45, one or more rounded bore holes 44, which are slightly larger than the diameter 54 of tubular arm 30, are punched into the upright surface 45*a* of the base body 45. Round holes 44 include on their circumferences 67 one or more slot or notched openings 68 corresponding to such size so as to receive threaded 31 end of tubular arm 30 and projections 52 therethrough. The location of bore holes 44 functions to quickly locate and align the tubular arm 30 arm in the proper alignment with bore holes 44 to base body 45. Upon passing the end 31 of the tubular arm 30 through upright wall 45*a* of base body 45 until the projections 52 are located in the slots 68 of bore holes 44. For tightening, a nut 56 is then threaded onto the end 31 of tubular arm 30 and tightened, which also obviates the need for a lockwasher. Once tightened, tubular arm 30 remains in its seated position within base body 40.

Figures 18, 19:
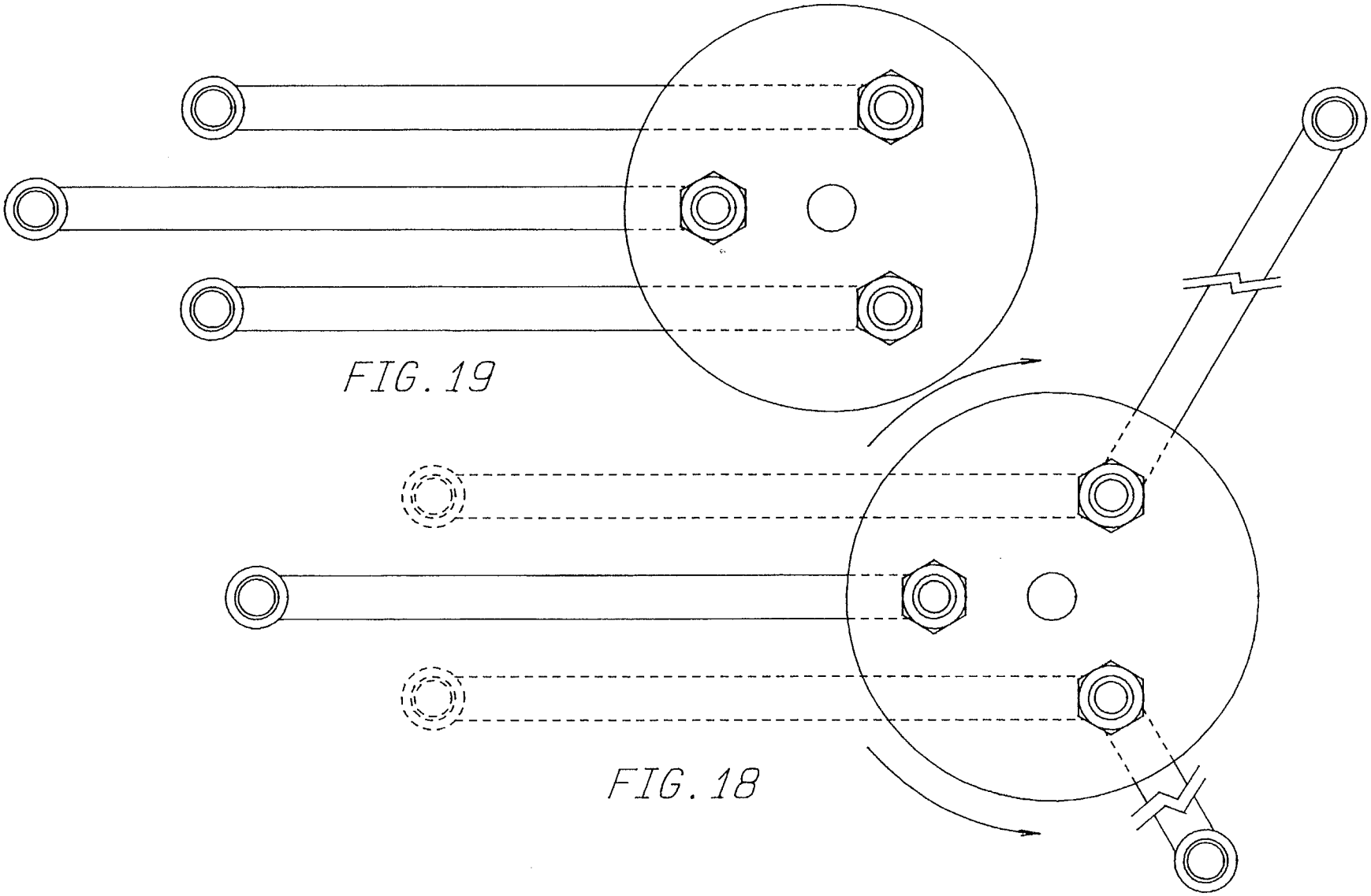
FIG. 18 is a top plan view of the assembly of the present invention as in the embodiment shown in FIGS. 9–15, shown in an open extended position for use.
FIG. 19 is a top plan view of the assembly of the present invention, as in the embodiment shown in FIGS. 9–15, shown in a swivelled closed position for packing.
Figure 20:
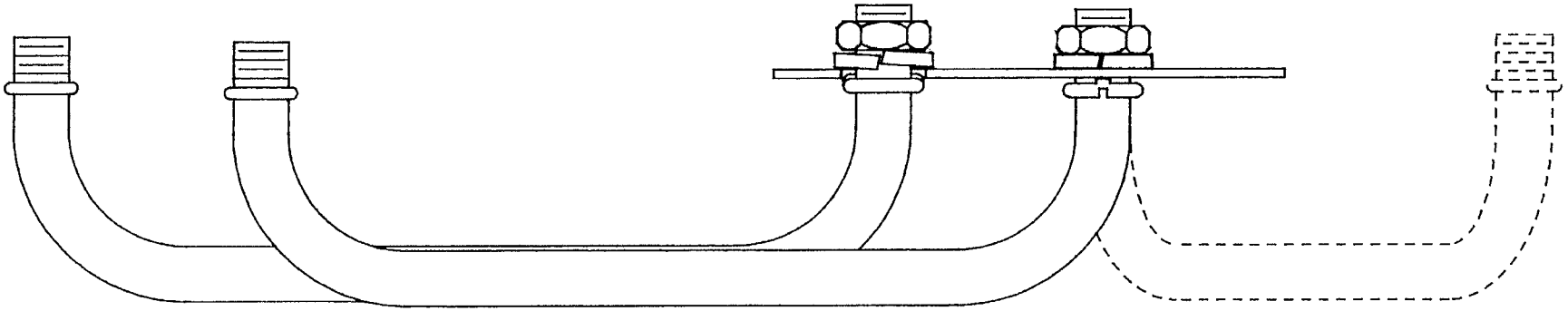
FIG. 20 is a side elevational view of one embodiment, wherein the tubular arms are fastened to a flat base plate.
Figure 21:
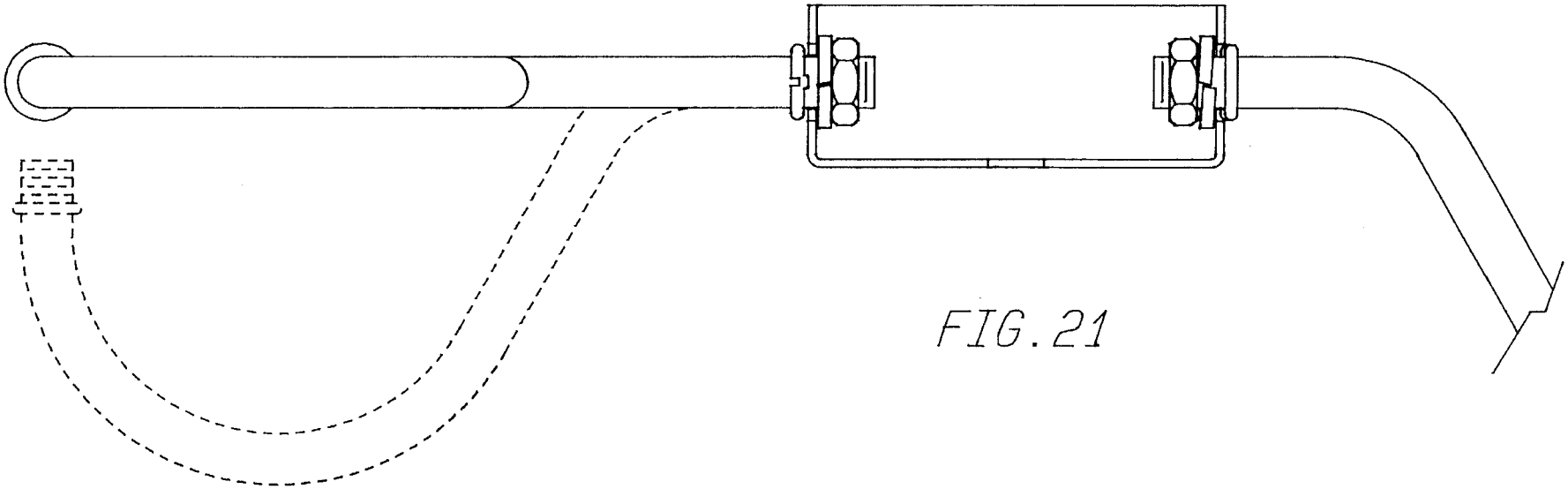
FIG. 21 is a side elevational view of a further embodiment wherein the tubular arms are fastened to a three dimensional body, such as an open cylinder.

Furthermore, as shown in FIGS. 18 and 19, if a suitable spring lockwasher is used under the nut 56 and nut 56 is tightened with sufficient torque so as to compress the spring just enough to allow tubular arm 30 to be swivelled out of position, this allows tubular arms 30 of a multi-armed plate 35 or body 45 to be moved into a more compact form, thereby reducing the size of the package required, resulting in lower packaging, shipping and storage costs. This swivelled assembly enables a purchaser of the lighting fixture or portable lamp to pull the arms 30 together until the projections snap into place. Nut 56 may be locked in place with an adhesive, such as "LOCTITE".

The assembly is therefore to easily and quickly locate and assemble tubular arms 30 onto plates 35 and cylindrical bodies 45 without the use of unnecessary assembly jigs and additional machined or cast fittings, which saves time and the costs of labor and jigs, and reduces the costs of packaging, shipping and storage by allowing the arms 30 or 40 to be swivelled to a more compact form, permitting smaller packaging.

It is noted that other modifications may be made to the present invention without departing from the spirit and scope of the present invention as noted in the appended claims.

We claim:

1. A lighting fixture or portable lamp assembly to facilitate the fast assembly and alignment of longitudinally extending arms to a base, said assembly comprising:

a base;

at least one longitudinally extending arm;

said arm having a circumferential bead formed near an end of said at least one longitudinally extending arm;

said bead having a flat surface thereon;

said bead further having at least one indentation in positional register with at least one projection protruding from an opposite flat surface of said bead;

said longitudinally extending arm having a threaded end located beyond said bead; and, said threaded end of said longitudinally extending arm being insertable within at least one bore in said base.

2. The assembly as in claim 1, said longitudinally extending arm being bent in the same plane as a line running through a center of said at least one longitudinally extending arm and said at least one projection.

3. The assembly as in claim 1, further comprising said at least one hole being slightly larger than a diameter of said longitudinally extending arm, said at least one hole being provided within a flat surface of said base.

4. The assembly as in claim 1, further comprising said base being an open outwardly extending three dimensional body, said body having a base wall and at least one side wall extending from said base wall, said at least one hole being slightly larger than a diameter of said longitudinally extending arm, said at least one hole being provided within said side wall of said base body.

5. The assembly as in claim 1 wherein at least one hole having an inside circumferential edge therein, said at least one hole having on said circumferential edge at least one notched slot opening, said at least one projection of said at least one longitudinally extending arm being insertable within said at least one notched slot opening of said at least one hole.

6. The assembly as in claim 1, further comprises a tightening nut and a spring lockwasher, said lockwasher being placed under said nut, said nut being tightened with sufficient torque so as to compress said spring lockwasher just enough to allow the arm to be swivelled out of position, for permitting said tubular arm of a multi-armed plate or body to be swivellable.

7. The longitudinally extending arm as in claim 1, wherein said arm is hollow.

8. The longitudinally extending arm as in claim 1 wherein said arm is tubular.

9. The longitudinally extending arm as in claim 1, wherein said arm is bent.

10. The base as in claim 1, wherein said base comprises a flat plate.

11. The base as in claim 4, wherein said body is a cylinder.

12. The base as in claim 4, wherein said body is open.

13. The assembly as in claim 1 further comprising a means to swivel said at least one longitudinally extending arm, said means comprising a spring lockwasher being applied with a predetermined torque to compress said spring lockwasher, said compression of said spring lockwasher permitting said at least one longitudinally extending arm to swivel from a first position to a second position with respect to said base.

14. The assembly as in claim 1, wherein said at least one longitudinally extending arm is bent in a plane coaxial with a center axis of said longitudinally extending arm.

* * * * *